United States Patent [19]

Herder et al.

[11] Patent Number: 4,724,549

[45] Date of Patent: Feb. 16, 1988

[54] PROTECTIVE HELMET AND LOCKING MEANS

[75] Inventors: Jaime Herder, Perth; Stephen R. Merralls, Wembley, both of Australia

[73] Assignee: Airsorb Pty. Ltd., Australia

[21] Appl. No.: 894,055

[22] PCT Filed: Dec. 11, 1985

[86] PCT No.: PCT/AU85/00315

§ 371 Date: Aug. 7, 1986

§ 102(e) Date: Aug. 7, 1986

[87] PCT Pub. No.: WO86/03383

PCT Pub. Date: Jun. 19, 1986

[30] Foreign Application Priority Data

Dec. 11, 1984 [AU] Australia ..... PG 8523

[51] Int. Cl.[4] ..... A42B 3/00; A44B 11/06; A44B 11/16

[52] U.S. Cl. ..... 2/411; 2/414; 2/421; 2/425

[58] Field of Search ..... 2/411, 414, 416, 425, 2/421

[56] References Cited

U.S. PATENT DOCUMENTS 3,790,962 2/1974 Plastino ..... 2/411
4,307,471 12/1981 Louell ..... 2/411
4,472,472 9/1984 Schultz ..... 2/411 X
4,519,099 5/1985 Kamiya et al. ..... 2/425 X
4,588,470 12/1985 Mitchell et al. ..... 2/414

FOREIGN PATENT DOCUMENTS 2075820 11/1981 United Kingdom ..... 2/425

*Primary Examiner*—Louis K. Rimrodt
*Attorney, Agent, or Firm*—Reising, Ethington, Barnard, Perry & Milton

[57] ABSTRACT

A protective helmet (10) characterized in that it comprises a shell (12) shaped to fit about the head of a wearer, the shell (12) comprising an interior and an exterior, a forward region (14) intended in use to be situated adjacent a forehead of the wearer and a rearward region (22) situated at an opposite end of the shell (12) from the forward region (14), and the shell (12) also comprising a basal perimeter, a resilient liner (50) comprising an inner concave side arranged, in use, adjacent the head of the wearer, and an outer convex side adjacent the interior of the shell (12) one or more securing straps (34) attached to the basal perimeter and a locking means (80) to, in use, lockably secure each strap (34), the resilient liner (50) being formed by a shaping process so that a plurality of discrete chambers (58) is located within the liner (50) or between the resilient liner (50) and the shell (12), the resilient liner (50) and the chambers (58) being intended, in use, to absorb mechanical shock imparted to the shell (12) by providing pneumatic and mechanical resistance thereto.

9 Claims, 12 Drawing Figures

PROTECTIVE HELMET AND LOCKING MEANS

The present invention relates to protective helmets.

FIELD OF THE INVENTION

In general protective helmets comprise a system of support straps forming a cradle arranged to receive the top of a wearer's skull or a foam material lined with a padded liner.

The former type of protective helmet usually has a shell comprising recesses to receive mounting means for the system of support straps.

When the protective helmet is struck, such as in an accident, the mounting means and/or the recesses can strike the skull of the wearer. Furthermore, the system of straps provides very little absorption of force when the protective helmet is struck.

The latter type of protective helmet is usually of a more heavy construction, more costly to manufacture and often not suitable for some applications. Usually such protective helmets are used in motoring such as motor cycle riding and are generally not suited to use in construction work or bicycle riding or the like.

SUMMARY OF THE INVENTION

The present invention provides a protective helmet of relatively light construction and which does not comprise a system of support straps.

In accordance with one aspect of the present invention there is provided a protective helmet, characterised in that it comprises a shell shaped to fit about a head of a wearer, the shell comprising an interior, an exterior, a forward region intended, in use, to be situated adjacent a forehead of the wearer and a rearward region situated at an opposite end of the shell from the forward region, the shell also comprising a basal perimeter, a resilient liner comprising an inner concave side arranged, in use, adjacent the head of the wearer and an outer convex side adjacent the interior of the shell, one or more securing straps attached to the basal perimeter and a locking means to, in use, lockably secure the or each securing strap, the resilient liner being formed by a shaping process so that a plurality of discrete chambers is located within the liner or between the resilient liner and the shell, the resilient liner and the chambers being intended, in use, to absorb mechanical shock imparted to the shell by providing pneumatic and mechanical resilience thereto.

In accordance with a further aspect of the present invention there is provided a locking means characterised in that it comprises a base portion, a shoe portion connected by a hinge means located intermediate of its length to an intermediate location of the base portion, a spring means arranged to fasten about the hinge means to hold and bias the base portion and the shoe portion together, the shoe portion comprising a first recess and the base portion comprising a second recess to be located adjacent the first recess, the second recess being provided to receive a member to be locked and the shoe portion comprising an edge arranged, in use, to engage with the member to be locked to prevent movement of the member out of the second recess.

In accordance with a still further aspect of the present invention there is provided a method of construction of a locking means characterised in that it comprises the steps of placing a shoe portion upon a base portion so that a first recess of the base portion corresponds with a second recess of the shoe portion, fitting a locating means of a second land portion hingedly coupled to a first land portion fixed to the base portion, to a further complementary shaped locating means of the shoe portion so that the base portion and the shoe portion are hingedly fixed together and clippably locating a spring means about the first land portion and the second land portion to bias them together.

BRIEF DESCRIPTION OF THE DRAWINGS

The present invention will now be described, by way of example, with reference to the accompanying drawings, in which.

DESCRIPTION OF THE INVENTION

Figures 1, 2:
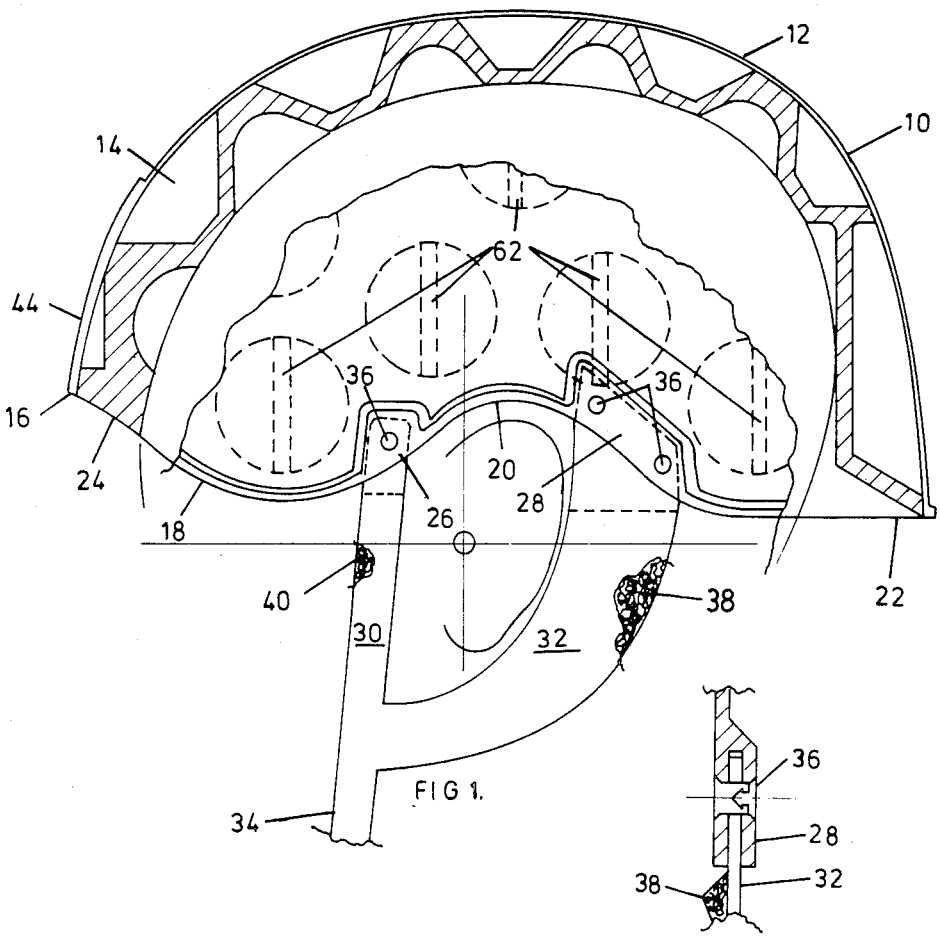
FIG. 1 is a part sectional side elevation of a protective helmet in accordance with the present invention shown with a part of a head of a wearer in it.
FIG. 2 is a front view of a portion of a securing strap of the protective helmet of FIG. 1.
Figures 3A, 3B:
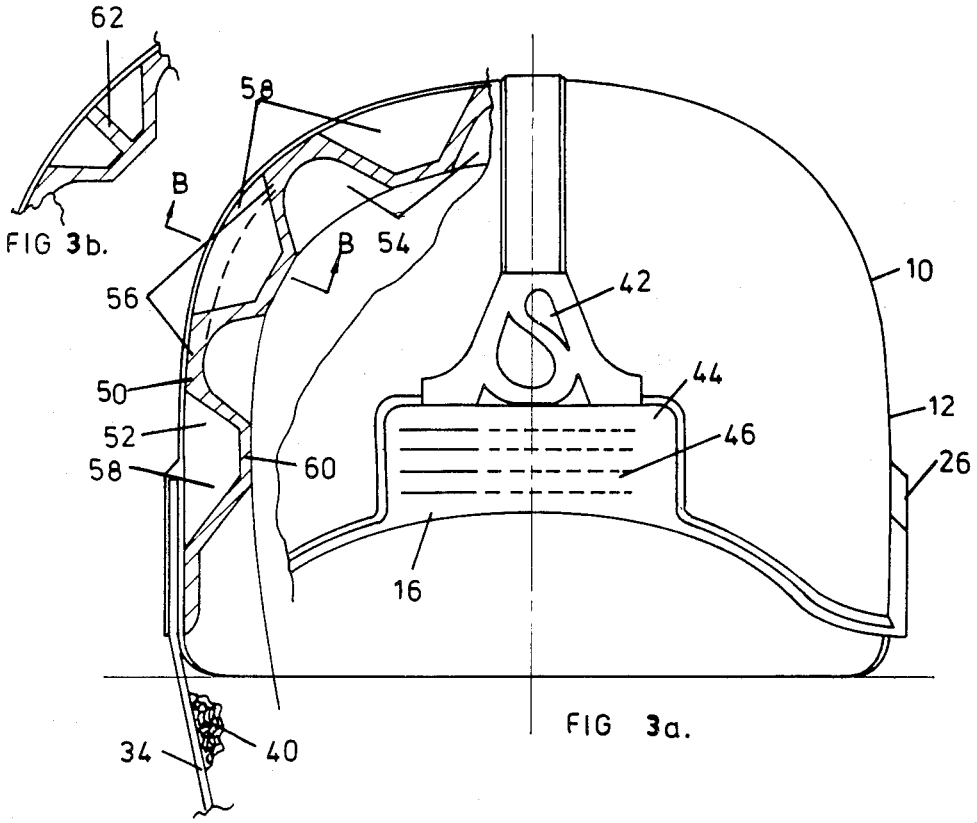
FIG. 3*a* is a part sectional front elevation of the protective helmet of FIG. 1.
FIG. 3*b* is a part section view of the protective helmet of FIG. 3*a* along the line B—B.
Figure 4:
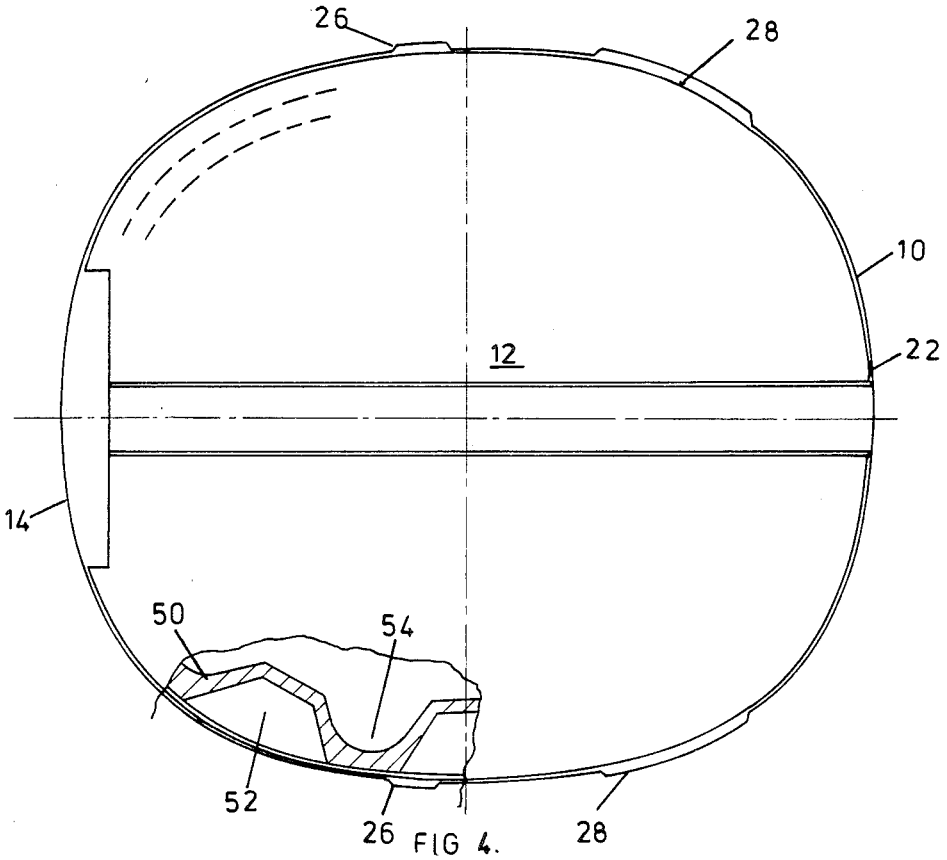
FIG. 4 is a part sectional plan view of the protective helmet of FIG. 1 shown without the part of the head.

In FIGS. 1, 3*a* and 4 there is shown a protective helmet 10 comprising a shell 12 shaped to fit a head of a wearer. The shell 12 is preferably made of a relatively rigid plastics material. It is envisaged that the shell 12 could be made in a forming process, such as, for example, an injection moulding process or the like. The shell 12 comprises an interior, an exterior, a forward region 14, and a basal perimeter. The forward region 14 is intended to correspond with the brow of the wearer of the helmet 10.

The basal perimeter preferably has a brow portion 16 which is raised to provide forward vision to the wearer when the wearer tilts his head at least partially downwardly and forwardly such as when riding a bicycle. The basal perimeter also comprises a temple portion 18 which is preferably arranged to, in use, at least partially cover a temple of the wearer and to protect same.

As shown in FIG. 1, the basal perimeter further comprises a portion 20 which is formed high enough to clear an ear of the wearer so that the helmet 10 may not substantially obstruct the hearing of the wearer. The shell 12 further comprises a rearward region 22 at which the basal perimeter is disposed at a height such as to provide protection to the occipital area of a skull of the wearer. The rearward region 22 is also at a height such that backward pivotal movement of the helmet 10 about the head of the wearer or backward pivotal movement of the head and the helmet 10 has little likelihood of resulting in the rear region 22 striking a neck of the wearer.

There is also provided a rib 24 located substantially about the basal perimeter of the helmet 10 to provide stiffening thereto. The rib 24 is intended to resist lateral deformation of the helmet 10.

Located at the rib 24 at opposing sides of the shell 12 are two pairs of receptacles 26 and 28. Each pair of receptacles 26 and 28 is located forwardly and aftwardly of the portion 20, respectively.

That is, each receptacle 26 is located forward of the ear of the wearer and each receptacle 28 is located aftward of the ear of the wearer.

The pairs of receptacles 26 and 28 are each provided to accommodate a respective end 30 and 32 of a securing strap 34. An inner margin of each of the receptacles 26 and 28 is formed flush with the interior of the shell 12. An outer margin of each of the receptacles 26 and 28 is formed so that there is a ledge at the junction of the ends 30 and 32 with respective ones of the receptacles 26 and 28 between the outer margin and the ends 30 and 32. The ledge reduces the likelihood of the ends 30 or 32 being severed by abrasion of the side of the helmet 12 with the ground for example, in an accident condition. The likelihood of such a cut of the straps 34 is reduced since the ends 30 and 32 are not secured to the exterior of the shell 12.

The ends 30 and 32 of the securing strap 34 are fixed in the receptacles 26 and 28 by rivets 36 or the like. Preferably, the rivets 36 are countersunk on the interior of the shell 12 as shown in FIG. 2 so as to reduce the possibility of injury to the wearer and to provide a flush surface for affixing a liner or the like to the interior of the helmet 10 as described hereinafter.

The end 32 comprises a resilient pad 38 bonded thereto and arranged, in use, to engage with a mastoid area of the head of the wearer to provide at least some protection thereto.

The end 30 similarly comprises a resilient pad 40 to provide at least some protection to a temple area and a cheek bone of the wearer.

As shown in FIG. 3*a* the shell 12 also comprises a vent 42 located at the forward region 14 of the helmet 10. The vent 42 is arranged to allow the passage of air into the helmet to cool the head of the wearer. Below the vent 42 is located a panel 44 arranged to receive a label 46. The label 46 is envisaged to contain information pertaining to the wearer, such as, the name, address, telephone number, blood group, allergies and the like of the wearer.

The protective helmet 10 also comprises a resilient liner 50 comprising an inner concave side and an outer convex side affixed contiguously to the interior of the shell 12 as shown in FIGS. 1, 3*a* and 4. The liner 50 is preferably formed from a resilient rubber or plastics material. Preferably, the liner 50 is substantially unable to absorb liquid such as water.

The resilient liner 50 is formed by a shaping process, such as, for example, a moulding process or an extrusion process or the like.

As can best be seen in FIG. 3*a*, the resilient liner 50 comprises a plurality of chambers conveniently referred to as dimple regions, on the outer convex side which are assigned reference numeral 52. Also the resilient liner 50 comprises a plurality of interconnected flow passages referred to as troughs 54.

Each dimple region 52 has a cusp 56 which is adhered to the interior of the shell 12 leaving an isolated discrete chamber called an air cell 58. The shaping process produces a plurality of the discrete air cells 58 located between the convex side of the liner 50 and the interior of the shell 12.

Each trough 54 at least partially surrounds a cusp 60, which is intended to locate against the head of the wearer.

Preferably, each of the cusps 60 is surrounded by one of the troughs 54.

Thus, in use, a plurality of the cusps 60 contact the head of a wearer and the troughs 54 surround the cusps 60 so that air may flow contiguously between the liner 50 and the head of the wearer.

It has been found that the allowable shapes of the air cells 58 may be limited by the shaping process used to make the liner 50. For example, in a two piece mould process, where half of the liner 50 is made at a time, the air cells 58 towards the forward region 14 and the rear region 22 may need to be elongated, as shown in FIG. 3*a*, to allow for removal of the liner 50 from the mould.

It is to be understood that the air cells 58 may be of various shapes. For example, the air cells 58 could be shaped in a circular, eliptical or elongated manner or in a rectangular or triangular manner.

It is envisaged that difficulties in moulding the resilient liner 50 could be overcome by using relatively circular air cells 58 about the upper and side regions of the shell 12 and relatively elongated air cells 58 at the forward region 14 and the rearward region 22 of the shell 12. However, such difficulties could also be overcome by using a multi-piece liner 50. The troughs 54 are interconnected and extend from the forward region 14 toward the rearward region 22 to allow relatively unrestricted flow of air through the vent 42 and contiguously between the head of the wearer and the liner 50 and out of the helmet 10 toward the rearward region 22. It has been found that in strenuous activities, where protective helmets are employed, cooling for the head of the wearer is necessary to reduce the likelihood of heat exhaustion.

Vanes 62 are used in some of the air cells 58 to provide further mechanical support for the head of the wearer as shown in FIGS. 1 and 3*a*. The vanes 62 effectively split the respective air cells 58 into two air cells 58. The air cells 58 provide pneumatic resistance to a force applied to the exterior of the shell 12.

The air cells 58 are intended to have a volume in the approximate range from $10^{-6}$ cubic meters to $2\times10^{-5}$ cubic meters, more specifically from $4\times10^{-6}$ cubic meters to $8\times10^{-6}$ cubic meters.

The pneumatic resistance provides initial protection to the head of the wearer from the exterior force. The exterior force may be force exerted on the helmet 10 by a falling brick, for example, or when the helmet 10 strikes the ground, such as when the wearer falls from a bicycle or the like.

As the exterior force increases the pneumatic resistance increases correspondingly as the air in the air cells 58 is compressed. During this time the cusps 60 are forced toward the shell 12 in the region of the area of impact of the exterior force.

Figure 5:
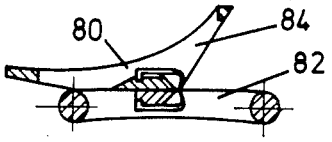
FIG. 5 is a side elevation of a locking means in accordance with a further aspect of the present invention.
Figure 6:
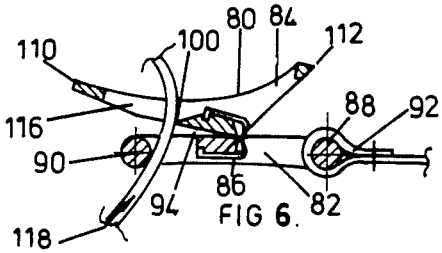
FIG. 6 is a cross-sectional view of the locking means of FIG. 5 shown in use.

As the air cells 58 are further compressed the resilient liner 50 provides mechanical resistance against the exterior force. The mechanical resistance is provided by the vanes 62 and from the cusps 56. If any of the air cells 58 rupture the corresponding cusps 60 provide a final level of mechanical resistance against the exterior force. As one of the air cells 58 ruptures the corresponding cusp 60 is forced to the interior of the shell 12. As the air cells 58 rupture the corresponding troughs 54 locate against the head of the wearer to also provide a final level of mechanical resistance. In FIGS. 5 and 6 there is shown a locking means 80 in accordance with a further aspect of the present invention.

The locking means 80 comprises a base portion 82 and a shoe portion 84. A hinge means 86 is provided to allow for hinged coupling of the base portion 82 and the shoe portion 84. The hinge means 86 is located intermediate of the length of both the base portion 82 and the shoe portion 84. The hinge means 86 may be integral with the base portion 82.

As particularly shown in FIG. 6 the base portion 82 comprises a rear bar 88 and a front bar 90. The rear bar 88 is intended to have secured to it a securing strap. For example, the rear bar may have secured to it a free end 92 of one of the securing straps 34 of the helmet 10.

Figure 7:
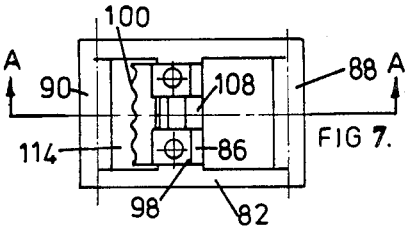
FIG. 7 is a plan view of a base portion of the locking means of FIG. 5.
Figure 8:
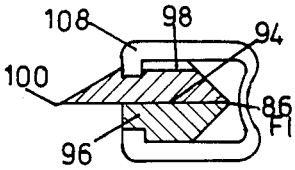
FIG. 8 is a cross-sectional side view of the base portion of FIG. 7 along the line A—A.

The base portion 82, as particularly shown in FIGS. 5, 7 and 8 also comprises a jaw means 94. The jaw means 94 comprises a first land portion 96 which is integral with the base portion 82. A second land portion 98 is connected to the first land portion 96 by the hinge means 86. The land portion 98 has a jagged edge 100 to, in use, engage with a free end of the other one of the securing straps 34. The land portion 98 projects forwardly of the land portion 96 so that, as shown in FIGS. 6 and 8, the jagged edge 100 of the land portion 98 extends past the land portion 96.

The land portion 98 also has a locating means referred to as indents 102. The indents 102 are intended to receive complimentary shaped locating means referred to as nodes 104 (shown in FIG. 11) of the shoe portion 84 located on tabs 106 formed intermediate of the length thereof.

The shoe portion 84 is attached to the base portion 82 by locating the nodes 104 firmly in the indents 102.

The locking means 80 also comprises a spring clip 108, as shown in FIGS. 7 and 8. The spring clip 108 may be made of a plastics material or a metal material.

Preferably, the locking means 80 comprises only corrosion resistant or corrosion free components. To assemble the locking means 80 the nodes 104 of the shoe portion 84 are inserted into the indents 102 of the base portion 82 the spring clip 108 is clippably located about the first land portion 96 and the second land portion 98 to bias the base portion 82 and the shoe portion 84 together.

Figure 11:
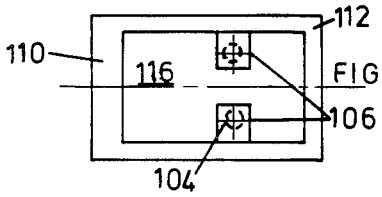
FIG. 11 is a plan view of a shoe portion of the locking means of FIG. 5.
Figure 9:
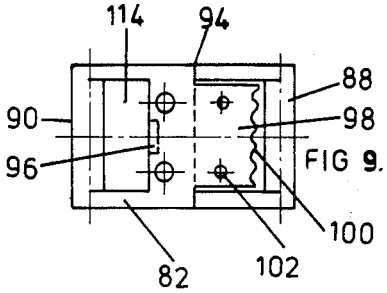
FIG. 9 is a plan view of the base portion of FIG. 7 shown in a moulded state.
Figure 10:
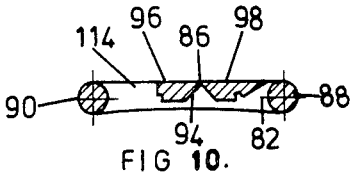
FIG. 10 is a cross-sectional side view of the base portion of FIG. 9.

The shoe portion 84 also comprises a toe 110 and a heel 112, as shown in FIGS. 5, 6 and 11.

The toe 110 is intended to be located adjacent the front bar 90 and the heel 112 is intended to be located adjacent the rear bar 88.

The locking means 80 may be used to secure the two securing straps 34 of the helmet 10 together. The strap 34 which is not fixed to the rear bar 88 is threaded through an aperture 114 in the base portion 82 and through a further aperture 116 in the shoe portion 84 in the direction of an arrow 118 as shown in FIG. 6.

The strap 34 in the apertures 114 and 116 frictionally engages with the jagged edge 100 to substantially prevent the strap 34 travelling in a direction opposite to the arrow 118.

It is envisaged that the locking means 80 of the present invention could be used to lock members other than the securing straps 34 of the protective helmet 10.

In use, the protective helmet 10 of the present invention is fitted over a head of a wearer with the forward region 16 of the shell 12 adjacent a forehead of the wearer. Ears of the wearer are located between the fixed strap ends 30 and 32.

The personal details of the wearer may be written on the label 46 and stuck onto the panel 44 as described hereinabove. To attach the locking means 80 to the helmet 10 the locking means 80 is assembled, as described hereinabove and one of the free ends 92 of the securing straps 34 is fixed to the rear bar of the base portion 82 of the locking means 80.

To secure the helmet 10 about the head of the wearer the other free end is passed through the aperture 114 and then through the aperture 116 whilst the heel 112 and the rear bar 88 are squeezed together by finger pressure applied by the wearer. The free end is then pulled to obtain a desired tension in the securing straps 34. The strap end is frictionally held by the jagged edge 100 of the locking means 80 to secure the helmet 10 to the head of the wearer.

When a wearer of the helmet 10 moves forwardly air enters the vent 42, passes about the troughs 54 contiguous with the head and out of the helmet 10 toward the rear region 22 to cool the head of the wearer.

To loosen the securing straps 34 the nose bar 110 is lifted or the heel 112 and the rear bar 88 are squeezed together and the strap end pulled out of the apertures 116 and 114 in a manner the reverse of that described hereinabove.

It is to be understood that the former is the preferred and quicker method of loosening the securing straps 34. Modifications and variations such as would be apparent to a skilled addressee are deemed within the scope of the present invention. For example, any suitable locking means could be used in place of the locking means 80 described herein. Also, the dimples 52 could be substituted by chambers located completely within the body of the resilient liner 50 and the entire convex extent of the resilient liner 50 adhered to the interior of the shell 12.

We claim:

1. A protective helmet, characterized in that it comprises a shell shaped to fit about a head of a wearer, said shell comprising an interior and an exterior, a forward region intended, in use, to be situated adjacent a forehead of the wearer and a rearward region situated at an opposite end of said shell from said forward region, a basal perimeter a vent located at said forward region, a resilient liner comprising an inner concave side arranged, in use, adjacent the head of the wearer and an outer convex side fixed adjacent the interior of said shell, an aperture located adjacent said vent to allow air to pass from outside said shell to inside said shell, a plurality of interconnecting through formed, on said inner concave side and arranged to, in use, provide a plurality of flow passages adjacent the head of the wearer to allow air to flow contiguous the head and to allow the air to exit said shell toward said rearward region, said resilient liner being formed by a shaping process so that a plurality of discrete chambers are located within the liner or between said resilient liner and said shell, said resilient liner and said chambers being intended, in use, to absorb mechanical shock imparted to said shell by providing pneumatic and mechanical resistance thereto, and one or more securing straps attached to said basal perimeter and a locking means, to in use, lockably secure said one or more securing straps.

2. A protective helmet according to claim 1, characterised in that at least some of said chambers comprise vanes extended from a location adjacent said inner concave side of said liner to a location adjacent said outer convex side of said liner or said interior of said shell, said vanes being arranged to reduce the volume of said chamber by splitting it into two chambers and providing further mechanical support.

3. A protective helmet according to claim 1, characterised in that said shell comprises two pairs of receptacles located on opposing side of said shell, one of said receptacles of said pairs of receptacles being located, in use, forwardly of an ear of the wearer and the other of said receptacle being located aftwardly of the ear of the wearer, said receptacles comprising an inner margin formed flush with said interior of said shell.

4. A protective helmet according to claim 3, characterised in that said securing straps are fixed into said receptacles and a ledge is provided between each of said securing straps and an outer margin of each of said receptacles so that, in use, in an accident condition grazing of either of the sides of said shell is less likely to lead to shearing of said securing straps.

5. A protective helmet according to claim 1, characterised in that a panel is provided on said shell and arranged to receive personal details of the wearer of said protective helmet.

6. A protective helmet according to claim 1, characterized in that said basal perimeter comprises a brow portion at said forward region, said brow portion being upwardly curved so that, in use, vision of the wearer is substantially unrestricted thereby.

7. A protective helmet according to claim 1, characterised in that said chambers have a volume in the range from $10^{-6}$ cubic meters to $2\times10^{-5}$ cubic meters.

8. A protective helmet according to claim 7, characterised in that said range is from $4\times10^{-6}$ cubic meters to $8\times10^{-6}$ cubic meters.

9. A protective helmet according to claim 1 characterized in that said interconnecting troughs surround and isolate said discrete chambers to form a plurality of cusps to be located, in use, in contact with the head of the wearer.

* * * * *